US005928035A

United States Patent [19]

Jankowsky et al.

[11] Patent Number: 5,928,035

[45] Date of Patent: Jul. 27, 1999

[54] PRINTED CIRCUIT BOARD SOCKET

[75] Inventors: Meinrad Jankowsky, Töging/Inn; Reinhard Oberstarr, Polling, both of Germany

[73] Assignee: Otto Dunkel GmbH Fur Elektrotechnische Gerate, Muhldorf, Germany

[21] Appl. No.: 09/137,183

[22] Filed: Aug. 20, 1998

[30] Foreign Application Priority Data

Aug. 22, 1997 [DE] Germany ..... 197 36 607

[51] Int. Cl.[6] ..... H01R 13/648

[52] U.S. Cl. ..... 439/607; 439/83

[58] Field of Search ..... 439/607, 608, 439/83

[56] References Cited

U.S. PATENT DOCUMENTS

| | | | |
|---|---|---|---|
| 4,628,410 | 12/1986 | Goodman et al. | 439/607 |
| 4,679,883 | 7/1987 | Assini et al. | 439/607 |
| 5,037,316 | 8/1991 | Fukushima et al. | 439/83 |
| 5,186,633 | 2/1993 | Mosser et al. | 439/83 |
| 5,685,739 | 11/1997 | Davis et al. | 439/607 |
| 5,755,595 | 5/1998 | Davis et al. | 439/607 |
| 5,797,770 | 8/1998 | Davis et al. | 439/607 |

FOREIGN PATENT DOCUMENTS

| | | |
|---|---|---|
| 4307134 | 9/1994 | Germany . |
| 296 02 268 U | 11/1996 | Germany . |

OTHER PUBLICATIONS

Patent Abstracts of Japan, vol. 13, No. 493, JP 1–197978, "Connector for Mounting Substrate . . . ", Nov. 8, 1989.

Journal "Electrotechnik", Nov. 24–27, 1987, p. 136.

*Primary Examiner*—Neil Abrams

*Assistant Examiner*—T C Patel

*Attorney, Agent, or Firm*—Jacobson, Price, Holman & Stern, PLLC

[57] ABSTRACT

The printed circuit board socket comprises a cross-sectionally rectangular metal socket housing (1), fixable to a circuit board (2) and an insulator (3), having a corresponding rectangular cross-section, which is inserted in the socket housing. The insulator preferably has four signal contacts (4), constructed as contact pins, which are located in juxtaposed manner in one plane and standardized according to the USB concept, which on plugging in the bus plug cooperate with the four juxtaposed opposite contacts provided therein and produce the electric contact. These signal contacts (4) are connectable by means of downwardly directed connection ends (5) to the contact points of the circuit board (2). A particularly space-saving, but still firm hold-ensuring construction, which is connected by a simpler soldering method, is characterized in that the bottom of the socket housing (1) is solderable in the reflow process to the circuit board (2) by supporting and connecting areas (11', 11") ensuring a spacing from the circuit board (2). In the bottom area of the socket housing (1) is provided a channel (12) through which the downwardly directed and then bent connection ends (5), constructed as SMT contacts, of the signal contacts (4) of the insulator (3) inserted in the socket housing (1) extend to the associated conductors of the circuit board (2). The supporting and connecting areas are formed by fixing plates (11', 11"), bent round by approximately 180° downwards and rearwards and emanating from the lower leading edge of the socket housing (1) and which in each case have a punched out hole with a collar (16), facing the circuit board and shaped on the rim of the hole and which engages in an opening (17) of the circuit board (2).

6 Claims, 3 Drawing Sheets

PRINTED CIRCUIT BOARD SOCKET

Figure 1:
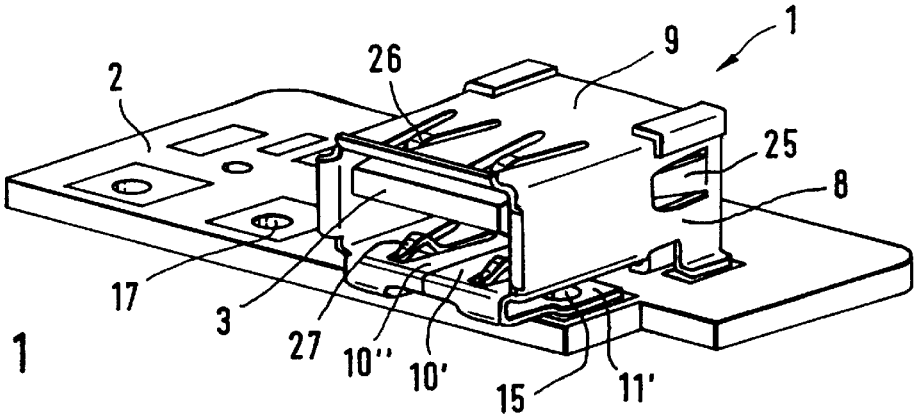

The invention relates to a printed circuit board socket having a cross-sectionally rectangular metal socket housing fixable on a circuit board and an insulator having a corresponding rectangular cross-section and inserted in the socket housing, which has four signal contacts, standardized according to the USB concept, which are juxtaposed in a plane and constructed as contact springs, which on plugging in the bus plug cooperate with the four juxtaposed opposite contacts provided therein and produce the electrical contact and which are connectable by means of downwardly directed connection ends to the contact points of the circuit board.

In a known printed circuit board socket of this type (DE 296 02 268 U1), the wall of the socket housing rests directly on the circuit board. Both the screening contacts of the socket housing and the four juxtaposed signal contacts are constructed as soldered in pins extending at right angles to the lower housing wall, inserted in solder contact holes of the associated circuit board and soldered from below therein according to the solder wave process.

This procedure leads to the disadvantage that, apart from the generally conventional SMT reflow process with which all the other components can be soldered to the circuit board, there is a need for a further soldering process, namely the solder wave process.

It is pointed out here that there is an extensive published prior art dealing with the fixing of terminals of connectors to conductor tracks, e.g. using reflow technology, but this involves costly, time-consuming use of additional screw or rivet connections for mechanically relieving the soldered joints (Journal "Elektrotechnik", 24/27.11.1987, p 136).

The connection of contacts of multipoint connectors with printed circuit boards is also known (DE 43 07 134 A1), in that the contact ends are inserted in holes in the circuit boards, where they are soldered. However, this method is also time and labour-intensive.

Reference is also made to the known fixing of a multipole connector to a printed circuit board using metallic L-shaped suspension clips giving the connector the necessary hold and which are used for soldering to the circuit board and which are provided with a through hole for increasing the fixing forces (Jp 1-197 978 A).

Another known fixing method for electric connectors to printed circuit boards (U.S. Pat. No. 5,037,316) also makes use of a complicated soldered joint, because here the connector is provided with transversely directed projections, which cooperate with holes in the circuit board receiving them. However, this manner of fixing connectors to a circuit board fails to provide the expert with the teaching of fixing USB circuit board socket housings to circuit boards in a simpler and more reliable way than in the aforementioned, known fixing method.

Thus, the problem of the invention is to permit a much simpler, but still reliable fixing and connection of the USB circuit board sockets to the circuit boards with a single soldering process.

According to the invention this problem is solved in that, the socket housing is solderable at the bottom by means of supporting and connecting areas ensuring a spacing from the circuit board, to said circuit board in the reflow process and in the bottom area of the socket housing is provided a channel, through which extend the downwardly directed and then bent connection ends of the signal contacts of the insulator inserted in the socket housing to the associated conductors of the circuit board and to which they can be soldered due to their construction as SMT contacts.

It has proved very appropriate from the production standpoint, if at least some of the supporting and connecting areas ensuring the spacing of the socket housing with respect to the circuit board to be formed by a fixing plate, starting from the lower, leading edge of the socket housing and then bent round by approximately 180° downwards and rearwards. These fixing plates ensure that the plugging forces acting on the metal socket housing during the plugging process are transferred to the circuit board substantially directly under the mouth region thereof, without a greater space requirement existing.

It has proved particularly advantageous for each plate to have a punched-out hole with a collar, facing the circuit board and formed on the rim of the hole and which engages in an opening of the circuit board. This collar absorbs horizontal plugging forces in a particularly simple manner and positively to the circuit board.

According to a further development of the invention, a particularly uniform bearing of the connection ends on the circuit board is ensured in that the underside of the insulator has a reinforced area projecting into the channel of the socket housing with preferably five shaped webs and that the connection ends of the contact springs are located between these webs.

A precise positioning of the connection ends relative to the circuit board exists if the insulator has at least two transversely projecting guide pins, which engage in associated recesses of the circuit board.

Further details, advantages and features can be gathered from the following description, with reference to the attached drawings, wherein show:

FIG. 1 A perspective view of a printed circuit board socket fixed to a circuit board, roughly in a scale of 3:1.

Figure 2:
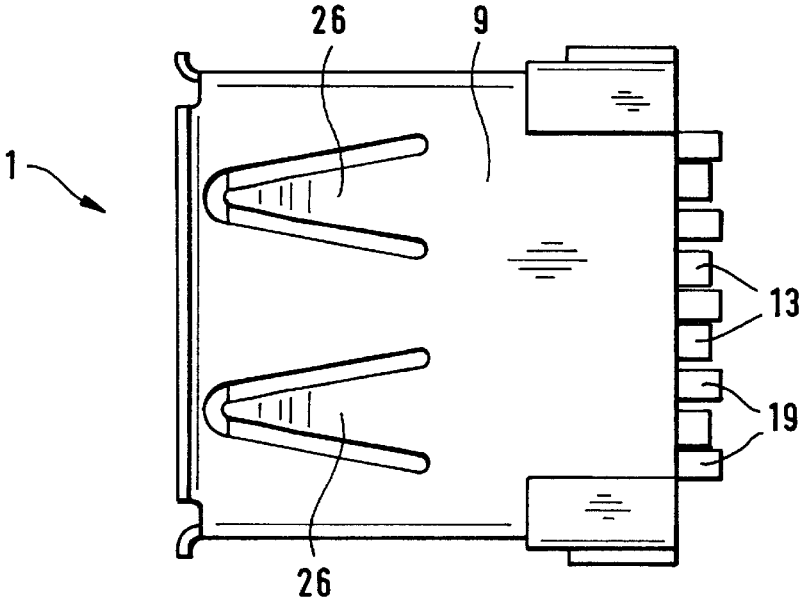

FIG. 2 A plan view on a larger scale of the circuit board socket.

Figure 3:
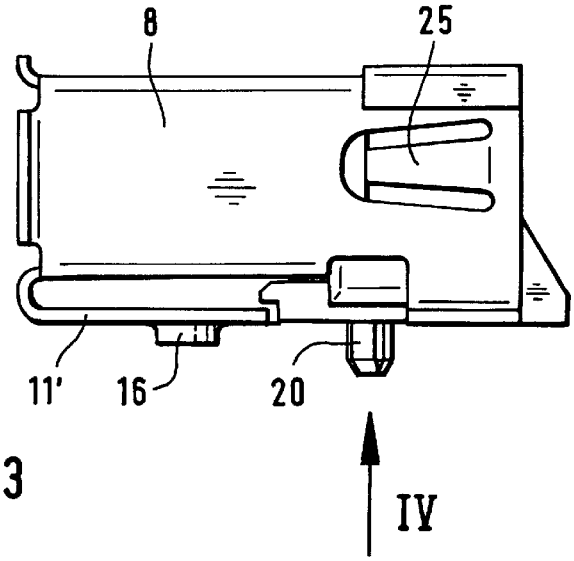

FIG. 3 A side view of the circuit board socket according to FIG. 2.

Figure 4:
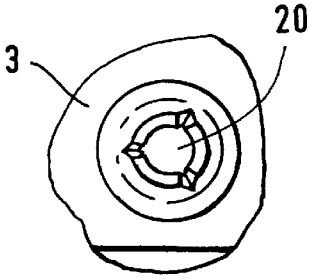

FIG. 4 A detail of the underside of the circuit board socket in the direction of arrow IV in FIG. 3.

Figure 5:
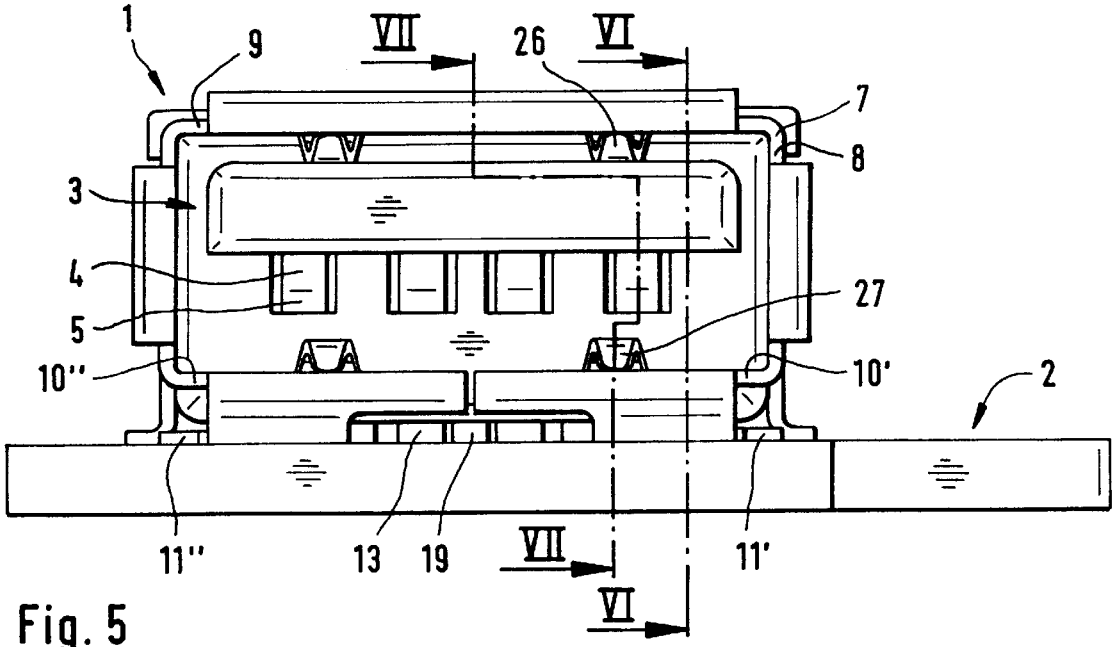

FIG. 5 A front view of the circuit board socket on a further increased scale.

Figure 6:
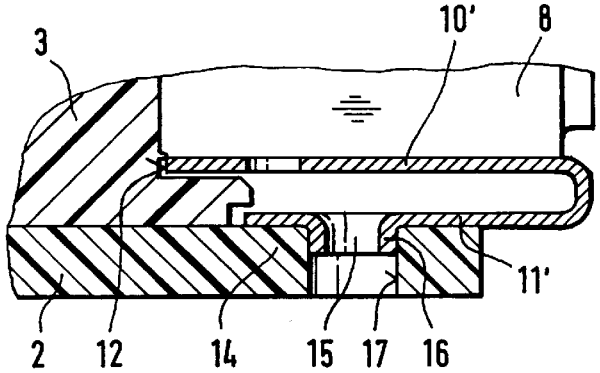

FIG. 6 A cutaway view of a detail along line VI—VI of FIG. 5.

Figure 7:
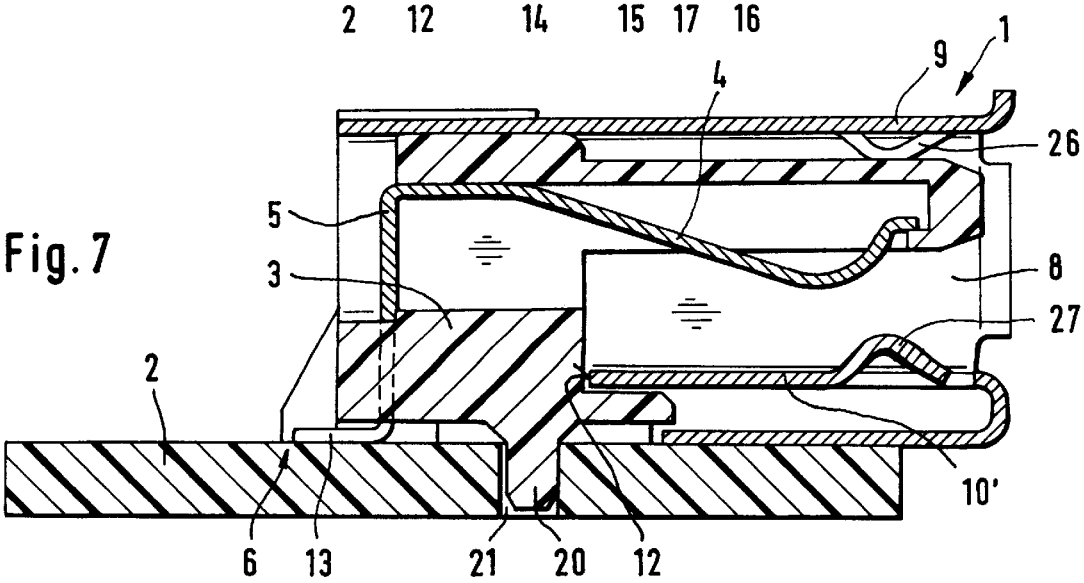

FIG. 7 A cutaway view along line VII—VII of FIG. 5.

Figure 8:
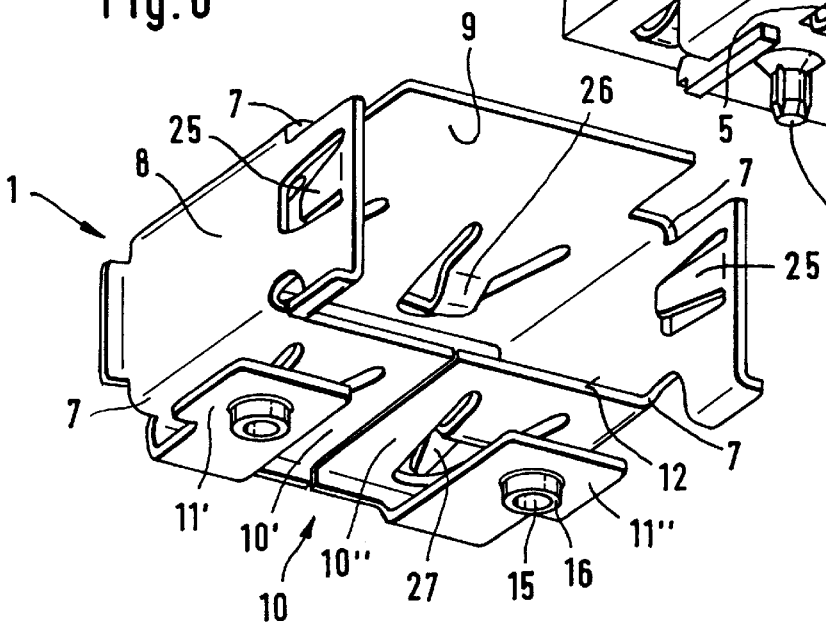

FIG. 8 A perspective view of the metal socket housing, inclined from below and rear.

Figure 9:
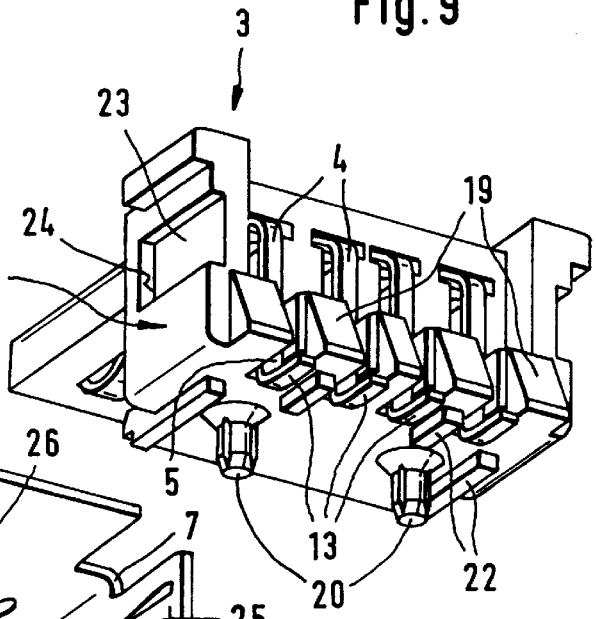

FIG. 9 An identical, perspective view of the insulator insertable from the rear into the housing according to FIG. 8.

The drawings show that the circuit board socket comprises a cross-sectionally rectangular, shield-forming metal socket housing 1, which is fixable to a printed circuit board 2, and an insulator 3, having a corresponding, rectangular cross-section and inserted in the housing 1. In said insulator 3 are inserted four signal contacts constructed as contact springs and juxtaposed in a single plane, being standardized according to the USB concept. On plugging in the not shown bus plug, the latter cooperate with the four juxtaposed contacts provided therein and produce the electrical contact. They are connectable to the contact points 6 of the circuit board 2 by means of downwardly directed connection ends 4.

The metal socket housing 1 shown in FIG. 8 is produced as a punched bent part from a sheet metal strip. It has four bending edges 7, which on the one hand form the two housing narrow sides 8 and on the other, the upper housing wall 9, as well as the housing bottom 10 with the two half as large side parts 10' and 10", which are directed towards one another. This housing bottom 10 of the metal socket housing 1 is firmly mechanically connectable to the circuit board 2 by means of supporting and connecting areas 11', 11" ensuring a spacing from the circuit board 2. In the bottom area of the socket housing is provided a channel 12, clearly visible in FIG. 8, through which the connection ends 5 of the four signal contacts 4, which are downwardly directed and then bent and run out as SMT contacts 13 after inserting the insulator 3 in the housing 1, extend to the not shown, associated conductors of the circuit board 2. The supporting and connecting areas ensuring the spacing of the socket housing 1 from the circuit board 2 are in each case formed by a fixing plate 11', 11" bent by approximately 180° downwards and rearwards and emanating from the lower leading edge of the socket housing 1, in the vicinity of the two side parts 10', 10" of the housing bottom 10.

With each of these fixing plates 11', 11" is associated a fixing zone 14 of the circuit board 2. FIGS. 6 and 8 particularly clear show that each fixing plate 11', 11" has a punched out hole 15 with a collar 16, facing the circuit board 2 and shaped on the rim of the hole. The collars are in each case insertable into a hole 17 of the fixing zone 14 of the circuit board 2. This ensures a particularly reliable positioning of the metal socket housing relative to the circuit board 2. On its underside, the insulator 3 is provided with a reinforced area 18, which projects into the channel 12 of the socket housing 1. It has five shaped, reinforcement-assisting webs 19. Between the latter, the connection ends 5 are provided with the SMT contacts 13 of the signal contacts 4.

Beneath the underside, the insulator 3 is provided with at least two, transversely projecting guide pins 20, which engage in associated recesses 21 of the circuit board 2.

As can be readily gathered from FIG. 9, onto the underside of the insulator 3 are shaped four, flat, substantially parallelepipedic support legs 22, by means of which the insulator 3, in the state inserted in the socket housing 1, rests on the circuit board 2.

The securing of the position of the insulator 3 in the state inserted in the socket housing 1 is brought about by lateral channels 23 with a front boundary edge 24, behind which, following the insertion into the socket housing 1, in each case engages one locking tongue 25 punched out of the housing narrow sides 8.

FIGS. 5, 7 and 8 very clearly show tongue-like locking hooks 26, 27 punched out of the upper housing wall 9 or housing bottom 10, which engage in channels of the shielding housing of the bus plug in the plugged in state.

We claim:

1. Printed circuit board socket for being coupled with a bus plug, said printed circuit board socket comprising a cross-sectionally rectangular metal socket housing fixable on a circuit board and an insulator having a corresponding rectangular cross-section and inserted in the socket housing, which has four signal contacts, which are juxtaposed in a plane and constructed as contact springs, which on plugging in the bus plug cooperate with the four juxtaposed opposite contacts provided therein and produce the electrical contact and which are connectable by means of downwardly directed connection ends to the contact points of the circuit board, the socket housing being solderable at the bottom by means of supporting and connecting areas ensuring a spacing from the circuit board, to said circuit board in the reflow process and in the bottom area of the socket housing a channel is provided, through which the downwardly directed and then bent connection ends of the signal contacts of the insulator inserted in the socket housing extend to the associated conductors of the circuit board to which they are solderable due to their construction as SMT contacts, at least some of the supporting and connecting areas ensuring the spacing of the socket housing form the circuit board, are in each case formed by a fixing plate bent round by approximately 180° downwards and rearwards and emanating from the lower leading edge of the socket housing.

2. Printed circuit board socket according to claim 1, wherein on its underside, the insulator has an area projecting into the channel of the socket housing and which is reinforced by five shaped webs and that the connection ends of the signal contacts are located between said webs.

3. Printed circuit board socket according to claim 2, wherein the insulator is provided with at least two, transversely projecting guide pins, which engage in associated recesses of the circuit board.

4. Printed circuit board socket for being coupled with a bus plug, said printed circuit board comprising a cross-sectionally rectangular metal socket housing fixable on a circuit board and an insulator having a corresponding rectangular cross-section and inserted in the socket housing, which has four signal contacts, which are juxtaposed in a plane and constructed as contact springs, which on plugging in the bus plug cooperate with the four juxtaposed opposite contacts provided therein and produce the electical contact and which are connectable by means of downwardly directed connection ends to the contact points of the circuit board, the socket housing being solderable at the bottom by means of supporting and connecting areas ensuring a spacing from the circuit board to said circuit board in the reflow process in the bottom area of the socket housing a channel is provided, through which the downwardly directed and then bent connection ends of the signal contacts of the insulator inserted in the socket housing extend to the associated conductors of the circuit board to which they are solderable due to their construction as SMT contacts, each fixing plate having a punched out hole with a collar facing the circuit board shaped on the rim of the hole and which engages in an opening of the circuit board.

5. Printed circuit board socket according to claim 4, wherein on its underside, the insulator has an area projecting into the channel of the socket housing and which is reinforced by five shaped webs and that the connection ends of the signal contacts are located between said webs.

6. Printed circuit board socket according to claim 5, wherein the insulator is provided with at least two, transversely projecting guide pins, which engage in associated recesses of the circuit board.

* * * * *